US008934790B2

(12) United States Patent
Uetake et al.

(10) Patent No.: US 8,934,790 B2
(45) Date of Patent: Jan. 13, 2015

(54) DEVELOPMENT APPARATUS AND IMAGE FORMING APPARATUS USING THE SAME

(75) Inventors: Shigeo Uetake, Takatsuki (JP); Toshiya Natsuhara, Takarazuka (JP); Junya Hirayama, Takarazuka (JP); Takeshi Maeyama, Ikeda (JP); Nofumi Mizumoto, Nara (JP); Makiko Watanabe, Uji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 467 days.

(21) Appl. No.: 12/943,714

(22) Filed: Nov. 10, 2010

(65) Prior Publication Data

US 2011/0116816 A1 May 19, 2011

(30) Foreign Application Priority Data

Nov. 13, 2009 (JP) ..... 2009-259728

(51) Int. Cl.
*G03G 15/08* (2006.01)

(52) U.S. Cl.
CPC ..... *G03G 15/0827* (2013.01)
USPC ..... 399/27; 399/252; 399/258

(58) Field of Classification Search
USPC ..... 399/35–27, 30, 222, 252, 258
See application file for complete search history.

(56) References Cited

U.S. PATENT DOCUMENTS

| | | | | |
|---|---|---|---|---|
| 2003/0161642 | A1* | 8/2003 | Ohkubo | 399/27 |
| 2004/0184825 | A1* | 9/2004 | Shin | 399/26 |
| 2008/0267641 | A1* | 10/2008 | Konishi et al. | 399/27 |

FOREIGN PATENT DOCUMENTS

| | | |
|---|---|---|
| JP | 61-212868 | 9/1986 |
| JP | 01-142766 | 6/1989 |
| JP | 03-007973 | 1/1991 |
| JP | 05-150636 | 6/1993 |
| JP | 06-258949 | 9/1994 |
| JP | 2000356902 | 12/2000 |
| JP | 2003-173052 | 6/2003 |
| JP | 2008-176236 | 7/2008 |

OTHER PUBLICATIONS

Japanese Office Action dated Jul. 23, 2013 for co-pending Japanese Patent Application No. 2009-259728.

* cited by examiner

*Primary Examiner* — Walter L Lindsay, Jr.
*Assistant Examiner* — Jessica L Eley
(74) *Attorney, Agent, or Firm* — Brinks Gilson & Lione

(57) ABSTRACT

A development apparatus and an image forming apparatus wherein optical high-precision detection of the toner amount of a toner layer formed on a toner carrying member is ensured even when the great amount of the toner is deposited on the toner carrying member by transferring all or a part of the toner on the surface of the toner carrying member onto a detecting roller, and wherein stable images are provided at all times.

21 Claims, 9 Drawing Sheets

DEVELOPMENT APPARATUS AND IMAGE FORMING APPARATUS USING THE SAME

This application is based on Japanese Patent Application No. 2009-259728 filed on Nov. 13, 2009, in Japan Patent Office, the entire content of which is hereby incorporated by reference.

TECHNICAL FIELD

The present invention relates to a development apparatus for developing an electrostatic latent image formed on an image carrier, and an image forming apparatus using the same.

BACKGROUND

There has been extensive use of an image forming apparatus using the electrophotographic process wherein an electrostatic latent image is formed on a photoconductor (image carrier) and is developed with toner. The developed toner image is transferred to a recording medium such as paper and is then fixed on the recording medium.

The development methods for developing an electrostatic latent image using a dry developer includes a one-component development method using toner alone and a two-component development method using both toner and carrier.

In the one-component development method, the toner is passed through the regulating section formed by a toner carrying member and the regulating plate pressed against the toner carrying member, thereby the toner is electrically charged and a desired thin toner layer is obtained. This method provides a simplified configuration, a compact and lightweight structure, and reduces cost of the apparatus. However, toner deterioration is accelerated by the strong stress by the regulating section and the electric charge acceptance of toner tends to be reduced. Further, when the surface of the regulating member as a member for providing the toner with electric charges and the surface of the toner carrying member are contaminated with the toner and external additive agent, the capability of providing the toner with electric charges will be reduced. This will cause a further reduction in toner charge, and will raise fogging or similar problems. For these reasons, the service life of the development apparatus is shorter in general.

In the meantime, in the two-component development method, toner is charged by the frictional charging process through mixture with the carrier. Therefore, this method ensures reduced stress. Further as a surface area of the carrier is large, the carrier has a higher resistance to contamination with the toner and external additive agent. These result in a longer service life of the apparatus. However, when an electrostatic latent image is developed on the image carrier, the image carrier surface is rubbed by the magnetic brush formed by the developer and the marks of the magnetic brush remain on the developed image in the two-component development method. Further, the carrier tends to be deposited on the image carrier. This will cause a problem of image defects.

A so-called hybrid development method is disclosed as a development method (refer to, for example, Unexamined Japanese Patent Application Publication No. H 05-150636), which solves the problems of image defects resulting from the remaining marks of the magnetic brush and others, and realizes high image quality comparable to that of the one-component development method as well as the service life as long as the two-component development. In this hybrid development method, the two-component developer is carried on the developer carrying member. From this two-component developer, only the toner is supplied to the toner carrying member for use in development.

In the hybrid development method, a bias voltage is applied, and toner is supplied onto the toner carrying member from the developer carrying member. The toner layer formed on this toner carrying member is used to develop the latent image on the opposed image carrier.

In the one-component development method or hybrid development method, the amount of the deposited toner in a layer formed on the toner carrying member or specific charge (electric charge per unit mass of the toner layer) depends on the environment where the apparatus is used (temperature, humidity, atmospheric pressure, and others) or number of sheets having been printed. This will cause changes in the state of image formation, particularly in the development characteristics. These changes result in changes in image density, and further in deterioration of the image quality. The solution to this problem requires accurate detection of the changing amount of toner held on the toner carrying member for the purpose of maintaining the image quality.

A method commonly used to minimize the fluctuation in image density is disclosed in the Unexamined Japanese Patent Application Publication No. 2003-173052, for example. In this method, a dummy toner image is developed on the image carrier and the toner amount of the developed toner image is detected at prescribed timings when the toner image (image to be transferred onto the sheet is not formed on the image carrier, for example, before and after image forming operation or during sheet-to-sheet interval in image forming operation. The development bias between the image carrier and toner carrying member is controlled to ensure the toner amount for maintaining the required image density. This method, however, fails to detect the toner amount during the image forming operation.

To solve these problems, Unexamined Japanese Patent Application Publication No. 2008-176236 discloses a method of using the detecting means to detect the toner amount in the toner layer formed on the toner carrying member instead of the toner amount held on the image carrier. This method uses an LED or LD as a light emitting means, which applies light to the toner layer. The reflected light is detected by the light-receiving element such as a photoelectric conversion element, and the absolute amount of the toner layer is obtained from the intensity of this reflected light.

Unexamined Japanese Patent Application Publication No. H06-258949 discloses a method of controlling and maintaining the toner amount held on the toner carrying member at a prescribed level. This control is based on the charge amount of the toner supplied from the developer carrying member to the toner carrying member. This charge amount is obtained by analyzing the current value flowing through the closed loop circuit made up of the toner carrying member, the developer carrying member and an electric power supply apparatus for bias connected to each of them.

In the method disclosed in Unexamined Japanese Patent Application Publication No. 2008-176236, the amounts of light reflected from the toner layer and the toner carrying member surface are measured, therefore, the changes in the amount of the toner cannot be detected in the area where there is too much absolute amount of toner on the toner carrying member. This results in poor detection accuracy and poor image quality. Further, in Unexamined Japanese Patent Application Publication No. H06-258949, the specific charge of toner itself depends on the working environment or the number of sheets having been printed. Thus, an appropriate toner amount cannot be obtained when control is provided based on the result of analysis of the detected current value, and satisfactory image quality cannot be obtained. For example, control is provided in such a way that, when there is an increase in the specific charge of the toner, the toner amount held on the toner carrying member will be reduced. This results in reduced image density.

SUMMARY

The present invention is intended to solve the aforementioned problems. It is accordingly an object of this invention to provide a development apparatus, and image forming apparatus wherein, high-precision detection of the toner amount is ensured, and stable image quality is provided accordingly.

In view of the foregoing, one embodiment according to one aspect of the present invention is a development apparatus, comprising:

a toner carrying member configured to hold and carry toner on a surface thereof and convey the toner to an image carrier facing the toner carrying member to develop an electrostatic latent image formed on the image carrier, wherein the toner is carried on a toner carrying area on the surface of the toner carrying member, said toner carrying area being broader in the direction of an axis of rotation of the toner carrying member than an image forming area on a surface of the image carrier in the direction of an axis of rotation thereof;

a detecting roller provided facing the toner carrying member, the detecting roller configured to hold and carry the toner transferred from a non-facing part of the toner carrying area on the surface of the toner carrying member, said part not facing the image forming area of the image carrier; and a toner detecting device configured to detect optically quantity of the toner transferred to and held on said detecting roller, or quantity of the toner remaining on said non-facing part on the surface of the toner carrying area without being transferred to said detecting roller.

Another embodiment according to another aspect of the present invention is a development apparatus, comprising:

a toner carrying member configured to hold and carry toner on a surface thereof and convey the toner to an image carrier facing the toner carrying member to develop an electrostatic latent image formed on the image carrier, wherein the toner is carried on a toner carrying area on the surface of the toner carrying member, said toner carrying area being broader in the direction of an axis of rotation of the toner carrying member than an image forming area on a surface of the image carrier in the direction of the axis of rotation thereof;

a detecting roller provided facing the toner carrying member, the detecting roller configured to hold and carry the toner transferred from a non-facing part of the toner carrying area on the surface of the toner carrying member, said non-facing part not facing the image forming area of the image carrier;

a toner detecting device configured to detect optically quantity of the toner transferred to and held on said detecting roller; and a controller configured to control transfer of the toner from the toner carrying member to the detecting roller so that a thickness of a toner layer formed on the detecting roller is smaller than a thickness of a toner layer formed on the toner carrying member before the toner being transferred to the detecting roller.

Another embodiment according to another aspect of the present invention is a development apparatus, comprising:

a toner carrying member configured to hold and carry toner on a surface thereof and convey the toner to an image carrier facing the toner carrying member to develop an electrostatic latent image formed on the image cannier, wherein the toner is carried on a toner carrying area on a surface of the toner carrying member, said toner carrying area being broader in the direction of an axis of rotation of the toner carrying member than the image forming area on a surface of the image carrier in the direction of the axis of rotation thereof;

a detecting roller provided facing the toner carrying member, the detecting roller configured to hold and carry the toner transferred from a non-facing part of the toner carrying area on the surface of the toner carrying member, said non-facing part not facing the image forming area on the surface of the image carrier; and a toner detecting device configured to detect optically quantity of the toner remaining on said non-facing part of the toner carrying area without being transferred to the detecting roller.

Another embodiment according to another aspect of the present invention is a development apparatus, comprising:

a toner carrying member configured to hold and carry toner on a surface thereof and convey the toner to an image carrier facing the toner carrying member to develop an electrostatic latent image formed on the image carrier, wherein the toner is carried on a toner carrying area on the surface of the toner carrying member, said area being broader in the direction of an axis of rotation of the toner carrying member than an image forming area on a surface of the image carrier in the direction of the axis of rotation thereof;

a detecting roller provided facing the toner earning member, the detecting roller configured to hold and carry the toner transferred from a non-facing part of the toner carrying area on the surface of the toner carrying member, said non-facing part not facing the image forming area on the surface of the image carrier, said detecting roller having translucency; and a toner detecting device configured to detect optically quantity of the toner transferred to and held on the detecting roller by measuring amount of light transmitted through the detecting roller and the toner layer formed on a surface of the detecting roller.

Other objects and features of the present invention will become apparent from the following detailed description considered in conjunction with the accompanying drawings. It is to be understood, however, that the drawings are designed solely for purposes of illustration and not serve to limit the invention, for which reference should be made to the appended claims.

DETAILED DESCRIPTION OF THE PREFERRED EMBODIMENTS

The following describes an embodiment of the present invention with reference to the drawings.

The following description refers to an example of the image forming apparatus equipped with a development apparatus based on the hybrid development method. To be more specific, a developer carrying member is used as a toner supply member. As is obvious, a development method should not be restricted to this method. Another development method such as a one-component development method can also be utilized.

(Structure and Operation of the Image Forming Apparatus)

Figure 1:
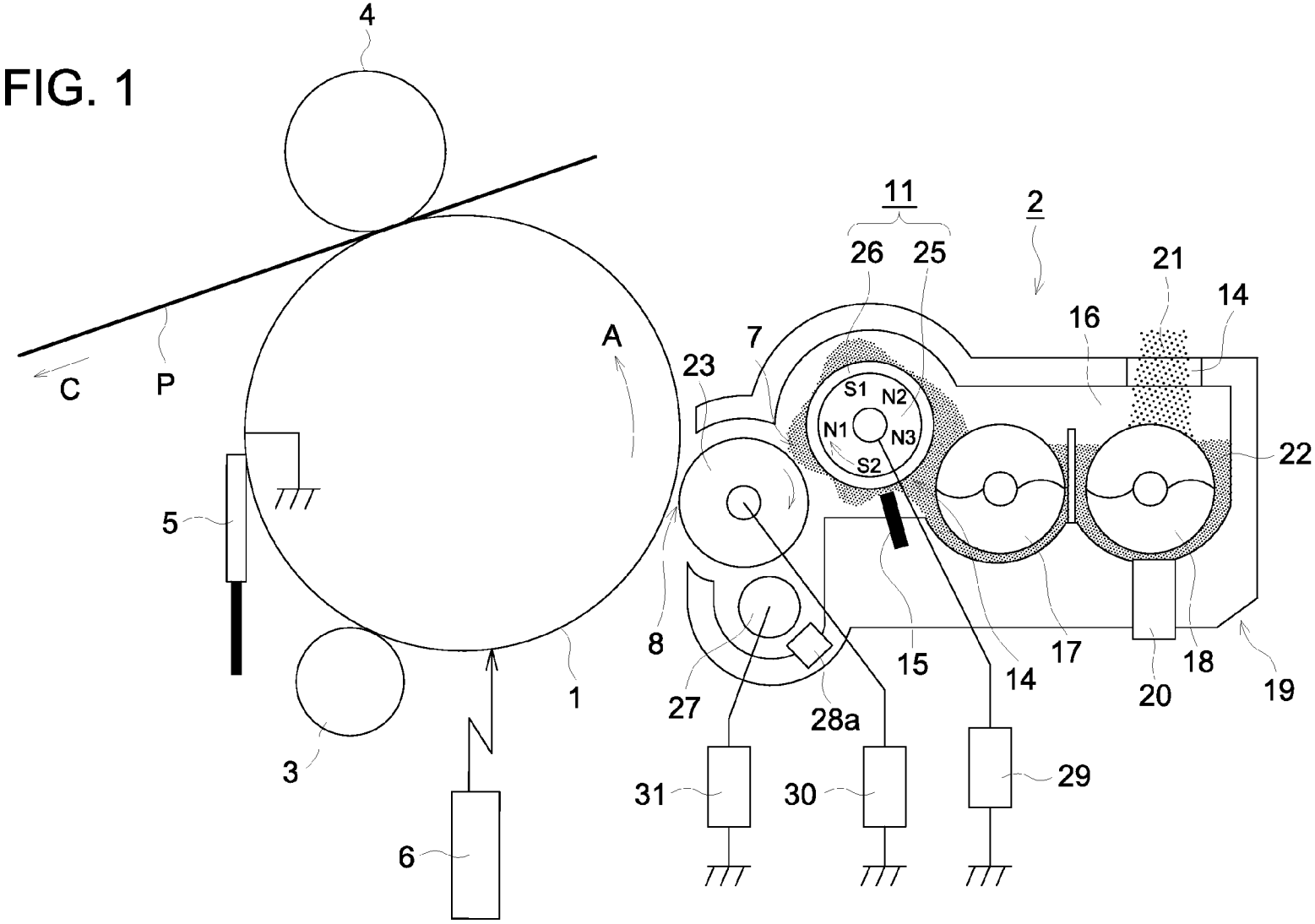
FIG. 1 is a cross sectional view showing an example of the structure of the major components in an image forming apparatus as a first embodiment of the present invention.

FIG. 1 is a cross sectional view showing an example of the structure of the major components in an image forming apparatus as a first embodiment of the present invention.

Referring to FIG. 1, the following describes the schematic structure and operation of the image forming apparatus of the present embodiment.

This image forming apparatus is a printer wherein the toner image formed on the image carrier (photoconductor) 1 by the electrophotographic process is transferred onto a transfer medium P such as a paper sheet to form an image thereon.

This image forming apparatus is equipped with an image carrier 1 for carrying an image. Around the image carrier 1, a charging member 3 for electrically charging the image carrier, a development apparatus 2 for developing the electrostatic latent image on the image carrier 1 with the toner, a transfer roller 4 for transferring the toner image on the image carrier 1 to the transfer medium P, and a cleaning blade 5 for removing the remaining toner from the image carrier 1 are arranged in that order in the rotating direction A of the image carrier 1.

After having been charged by the charging member 3, the image carrier 1 is exposed to light by the exposure device 6 equipped with a laser light-emitting device, for example, and thereby an electrostatic latent image is formed on the surface of the image carrier. The development apparatus 2 uses a toner to develop this electrostatic latent image and forms a toner image. After transferring the toner image on the image carrier 1 to the transfer medium P, the transfer roller 4 conveys the transfer medium P in the arrow-marked direction C of the drawing.

The toner image on the transfer medium P is fixed by the fixing apparatus (not illustrated). After that, the transfer medium P is ejected. The toner remaining on the image carrier 1 subsequent to the transfer is removed by the mechanical force of the cleaning blade 5.

A conventional technique based on the electrophotographic process can be used, as required, for the image carrier 1, the charging member 3, the exposure device 6, the transfer roller 4, and the cleaning blade 5 used in the image forming apparatus. For example, a charging roller is illustrated as a charging member 3 in the drawing, but instead, it may be a charging device which is not in contact with the image carrier 1. Further, the cleaning blade 5 may not be used.

The detailed description of the structure example of the development apparatus 2 will be introduced later.

(Developer Structure)

A hybrid development method is used in the present embodiment. An appropriate two-component developer can be used. To be more specific, the developer 22 used in the present embodiment includes toner and carrier for charging the toner.

There is no particular restriction concerning toner. A commonly used conventional toner can be used. The binder resin can include colorant and, if required, a charge controlling agent or mold releasing agent. Further, an external additive agent can also be added and processed. There is no particular restriction to the particle size of the toner. The particle size in the range from 3 through 15 μm is preferred in general.

This toner can be produced according to the conventional known method. For example, a pulverization method, emulsion polymerization method, and suspension polymerization method can be utilized.

The commonly used conventional binder resin, colorant, charge control agent, and mold-releasing agent can also be used for toner.

The conventional known agent can also be used as the aforementioned external additive agent. The opposite polarity particles having the charging polarity opposite to that of the toner can be used as the external additive agent.

There is no particular restriction to carrier. A conventional known carrier can be used. A binder type carrier or coating type carrier can be employed. There is no particular restriction to the particle size of the carrier. The preferred particle size is in the range of 15 through 100 μm.

The binder type carrier is obtained by dispersing magnetic fine particles in the binder resin. Positively or negatively charging particles can be fixed to the carrier surface. A surface coating layer can be provided.

The conventional known binder resin and magnetic fine particles can be used in the binder type carrier.

In the meantime, the coating type carrier is produced by coating the carrier core particles made of magnetic substances with resin. For the coating type carrier, positively or negatively charging particles can be fixed to the carrier surface, similarly to the case of the binder type carrier.

The mixture ratio of the toner and the carrier may be adjusted to get a desired amount of toner charge. The mixture ratio of toner is generally 3 through 50% by mass, preferably 6 through 30% by mass with respect to the total amount of the toner and the carrier.

(Structure and Operation of Development Apparatus 2)

Referring to FIG. 1, the following describes the details of the structural and operational examples of the development apparatus 2 of the present invention.

As described above, the development apparatus of this embodiment has a toner carrying member and a developer carrying member for supplying toner to the toner carrying member. In the development apparatus used in this embodiment, development is performed with the toner layer formed on the toner carrying member opposed to the image carrier. A plurality of toner carrying members can be used, or a plurality of developer carrying members can be used.

The developer 22 used in the development apparatus 2 is made of a toner and a carrier as described above, and is stored in a developer reservoir 16.

The developer reservoir 16 is formed of a developing device enclosure 19, and normally incorporates mixing and agitating members 17 and 18. The mixing and agitating members 17 and 18 mix and agitate the developer 22, and supply the developer 22 to the developer carrying member 11. An ATDC (Automatic Toner Density Control) sensor 20 for toner density detection is preferably arranged in the developing device enclosure 19 at a position opposed to the mixing and agitating member 18.

The development apparatus 2 normally has a supply section 14 so that the amount of toner to be consumed in the development area 8 is supplied in the developer reservoir 16. In the supply section 14, the supply toner 21 fed from a hopper (not illustrated) accommodating the same is supplied into the developer reservoir 16.

The developer carrying member 11 includes a magnetic member 25 fixedly arranged inside, and a freely rotatable sleeve roller 26 including the same. The developer 22 supplied to the developer carrying member 11 is retained on the surface of the sleeve roller 26 by the magnetic force of the magnetic member 25 inside the developer carrying member 11. The developer 22 is conveyed by the rotation of the sleeve roller 26, and the amount of the developer 22 to be passed is regulated by the regulating member (regulating blade) 15 arranged opposed to the developer carrying member 11.

The magnetic member 25 has five magnetic poles—N1, S1, N2, N3, and S2 (refer to FIG. 1) arranged in this order in the rotating direction of the sleeve roller 26.

Of these magnetic poles, the main magnetic pole N1 is arranged in the toner supply area 7 to face the toner carrying member 23. Further, north poles N2 and N3 having the same polarity for generating the repulsive magnetic field for separating the developer 22 from the sleeve roller 26 are arranged to face the internal side of the developer reservoir 16.

The toner supply bias voltage Vs for supplying toner to the toner carrying member 23 is applied to the developer carrying member 11 by the supply bias electric power supply 29 for the developer carrying member.

The toner carrying member 23 is arranged to face both the developer carrying member 11 and image carrier 1. The development bias voltage for developing the electrostatic latent image on the image carrier 1 is applied to the toner carrying member 23 by the development bias electric power supply 30 for the toner carrying member.

The detecting roller 27 is opposed to the circumference of the toner carrying member 23, and is located between the area where the toner carrying member 23 faces the developer carrying member 11 as a toner supply member, and the area where the toner carrying member 23 is opposed to the image carrier 1. In FIG. 1, the detecting roller 27 is located on the upstream side of the development area 8 with respect to the rotating direction of the toner carrying member 23, but instead, can be located on the downstream side. Further, a toner detecting device 28*a* for optically detecting the amount of toner held on the surface of the detecting roller 27 is arranged on the circumference of the detecting roller 27.

Similarly, referring to FIG. 1, the following describes the details of the operation example of the development apparatus 2 in the present embodiment.

The developer 22 inside the developer reservoir 16 is mixed and agitated by the rotation of the mixing and agitating members 17 and 18. Through the mixing and agitation, the developer 22 is frictionally charged, and circulated and conveyed inside the developer reservoir 16. Then the developer 22 is fed to the sleeve roller 26 on the surface of the developer carrying member 11.

This developer 22 is maintained on the surface of the sleeve roller 26 by the magnetic force of the magnetic member 25 inside the developer carrying member 11. The developer 22 is rotated and transferred on the sleeve roller 26 The amount of the developer 22 thus transferred on the surface of the sleeve roller 26 is regulated by the regulating member 15 arranged to face the developer carrying member 11.

The developer 22, having been regulated by the regulating member 15, is conveyed to the toner supply area 7 facing the toner carrying member 23.

In the toner supply area 7 where the toner carrying member 23 and the developer carrying member 11 face each other, the developer 22 is bristled by the main magnetic pole N1 of the magnetic member 25. The toner in the developer 22 is supplied to the toner carrying member 23 by the force which is applied to the toner and generated by the toner supply electric field having been formed according to the potential difference between the development bias Vb applied to the toner carrying member 23 and the toner supply bias Vs applied to the developer carrying member 11.

The development bias Vb obtained by superimposition of the AC voltage to the DC voltage is applied to the toner carrying member 23. The toner supply bias Vs obtained by superimposition of the AC voltage to the DC voltage is applied to the developer carrying member 11 as well. Then the electric field obtained by superimposition of the AC electric field to the DC electric field is formed in the toner supply area 7. The development bias Vb and/or toner supply bias Vs can be a DC voltage.

In the toner supply area 7, the toner layer supplied onto the toner carrying member 23 from the developer carrying member 11 is conveyed to the development area 8 by the rotation of the toner carrying member 23, and is supplied for development by the electric field formed by the development bias Vb applied to the toner carrying member 23 and the latent image potential on the image carrier 1.

In the development area 8, development is performed by the transfer of the toner by electric field through the development gap formed between the toner carrying member 23 and image carrier 1. After toner has been consumed in the development area 8, the remaining toner layer which has not been consumed in the development area 8 is conveyed to the toner supply area 7 by the rotation of the toner carrying member 23.

In the toner supply area 7, the toner remaining on the toner carrying member 15 subsequent to development is mechanically scraped off by the bristled developer 22 on the developer carrying member 11.

The developer 22 having passed through the toner supply area 8 is conveyed toward the developer reservoir 16 with the rotation of the sleeve 26. The developer 22 is separated from the developer carrying member 11 by the repulsive magnetic field formed by the magnetic poles N2 and N3 of the magnetic member 25, and is recovered into the developer reservoir 16.

When the supply control section (not illustrated) has detected from the output value of the ATDC sensor 20 that the toner density in the developer 22 has been reduced below the minimum toner density for ensuring image density, the supply toner 21 stored in the hopper is supplied into the developer reservoir 16 through the toner supply section 14 by the toner supply device (not illustrated).

(Method of Detecting the Amount of the Toner Held on the Toner Carrying Member)

The following describes the method of detecting the amount of the toner held on the toner carrying member.

Figure 2:
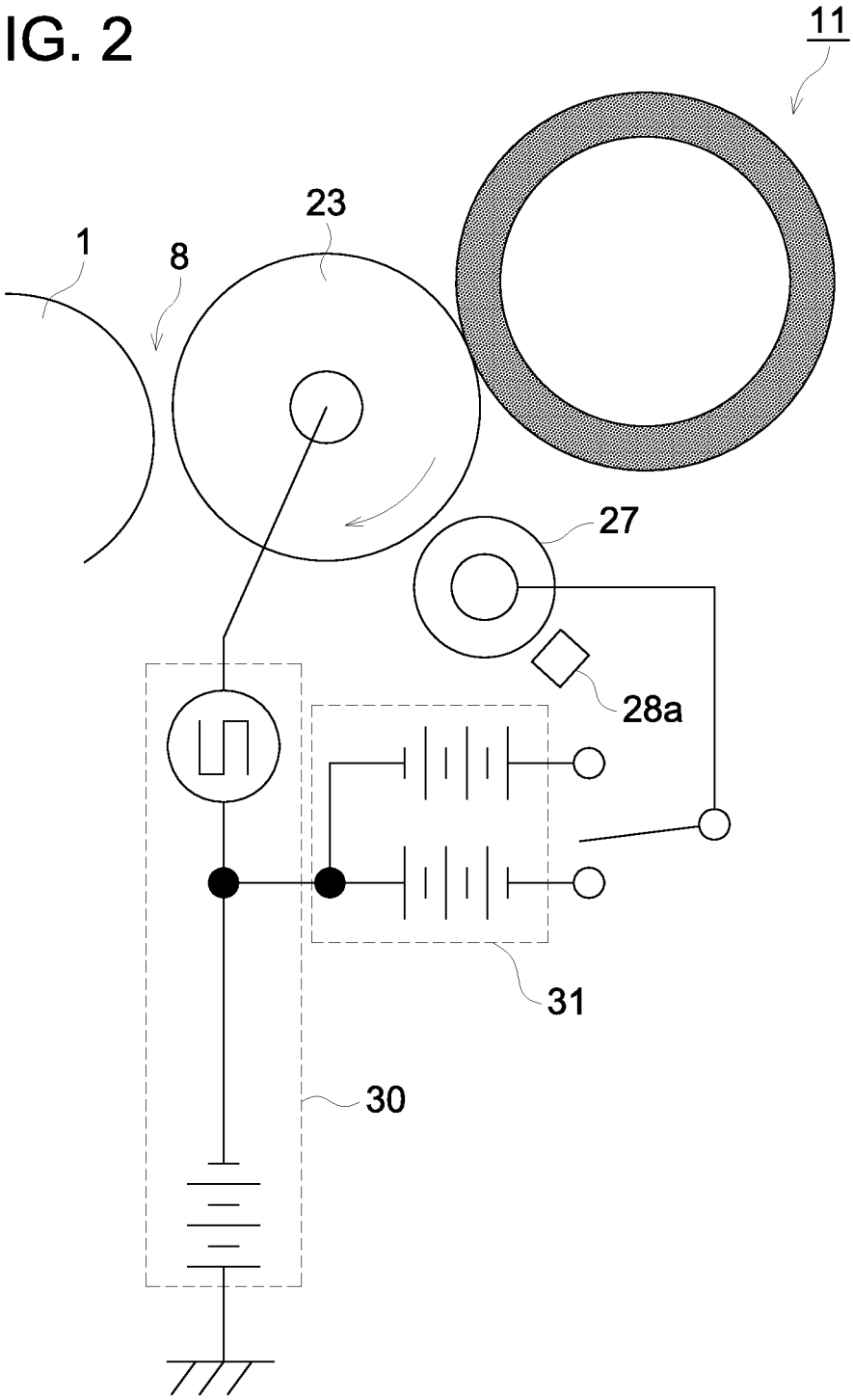
FIG. 2 is a schematic view showing an example of the structure of a toner detecting section for detecting the amount of toner held on a toner carrying member in the development apparatus of the present embodiment.

FIG. 2 is a schematic view showing an example of the structure of a detecting section for detecting the amount of the toner held on a toner carrying member in the development apparatus of the present embodiment.

In the development apparatus of this embodiment, it is important to stabilize the toner amount on the toner carrying member 23. To achieve this objective, it is essential to ensure accurate measurement of the toner amount supplied from the developer carrying member 11.

In the present embodiment, high-precision detection of the toner amount is ensured by installation of a detecting roller 27. The detecting roller 27 is placed facing the circumference of the toner carrying member 23. To be more specific, the detecting roller 27 is located between the area wherein the toner carrying member 23 faces the developer carrying member 11, and the area wherein the toner carrying member 23 faces the image carrier 1. In FIG. 2, the detecting roller 27 is arranged on the upstream side of the development area 8 where the toner on the surface of the toner carrying member 23 is conveyed. However, the detecting roller 27 can be arranged on the downstream side. Further, an optical detecting device 28*a* for detecting the toner amount held on the surface of the detecting roller 27 is arranged on the circumference of the detecting roller 27.

The following describes the operation of the detecting roller. The toner supplied to the toner carrying member 23 by the developer carrying member 11 is transferred onto the detecting roller 27 by the bias formed by superimposition of the AC voltage onto the DV voltage applied between the toner carrying member 23 and detecting roller 27. The DC voltage bias can be used to transfer the toner from the toner carrying member 23 to the detecting roller 27.

Figure 3:
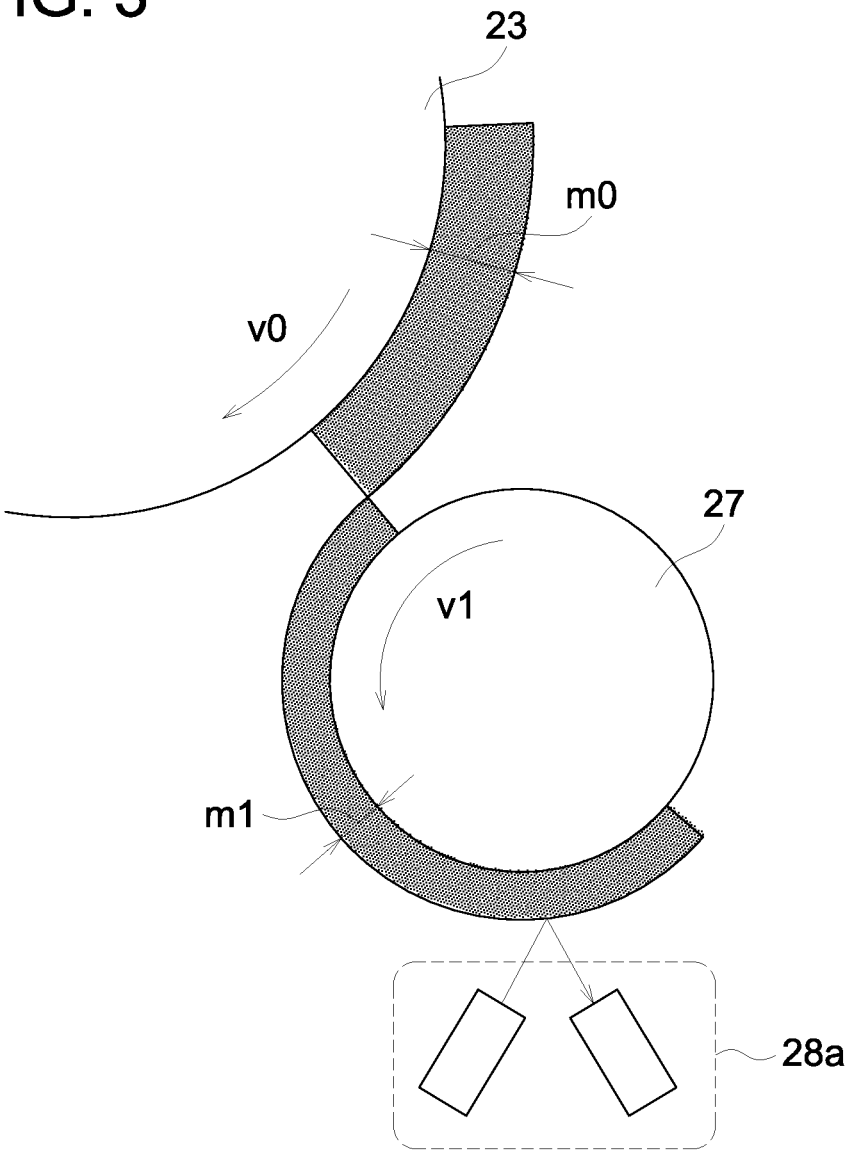
FIG. 3 is a schematic view showing an enlarged aspect of the area wherein the toner carrying member and a detecting roller are opposed to each other in the present embodiment.

To explain one of the embodiments of the present invention, FIG. 3 provides an enlarged aspect of the area wherein the toner carrying member 23 and detecting roller 27 faces each other. In the present embodiment, the circumferential speed v1 of the detecting roller 27 is set at a level higher than the circumferential speed v0 of the toner carrying member 23. Thus, the toner amount per unit area transferred onto the detecting roller 27 is smaller than that of the toner carrying member 23. To be more specific, if the circumferential speed ratio v1/v0 of the detecting roller 27 relative to the toner carrying member 23 is $\alpha$ the toner amount m1 per unit area on the detecting roller 27 is $1/\alpha$ ($m1=m0/\alpha$) of the toner amount m0 per unit area on the toner carrying member. In this manner, the toner amount per unit area on the detecting roller 27 can be reduced by a difference in circumferential speeds provided between the toner carrying member 23 and detecting roller 27. Reduction in the toner amount enables measurement of the toner amount by the optical toner detecting device 28*a* capable of obtaining the absolute value of the toner amount. This optical toner detecting device 28*a* emitting lights from a light emitting element (such as an LED) incorporated in the device toward the toner layer and detecting the light reflected by the light receiving element such as a photoelectric conversion element. When the toner amount on the detecting roller 27 can be detected, the toner amount on the toner carrying member 23 can be easily estimated, based on the difference in circumferential speeds. In FIG. 3, the toner carrying member 23 and detecting roller 27 are arranged without contacting each other, but can be placed in contact with each other if the toner is transferred from the toner carrying member 23 to the detecting roller 27. However, since the toner carrying member 23 and detecting roller 27 are provided with a difference in circumferential speeds, the non-contact arrangement is more preferred from the viewpoint of reducing the drive torque.

The toner amount m0 on the toner carrying member 23 is required to ensure a sufficient image density. Accordingly, the toner amount is often set at a level that is too large to be directly detected by a conventional optical device for detecting the toner amount by the light reflected from the toner layer on the toner carrying member 23. This conventional device has failed to provide high-precision detection.

However, in the present embodiment, when the toner is transferred to the detecting roller 27, the value is converted into the toner amount m1 that can be detected by the optical toner detecting device 28*a*. This arrangement makes it possible to measure the toner amount on the detecting roller 27, and to identify the toner amount on the toner carrying member 23 in a simple and accurate manner.

Figure 4:
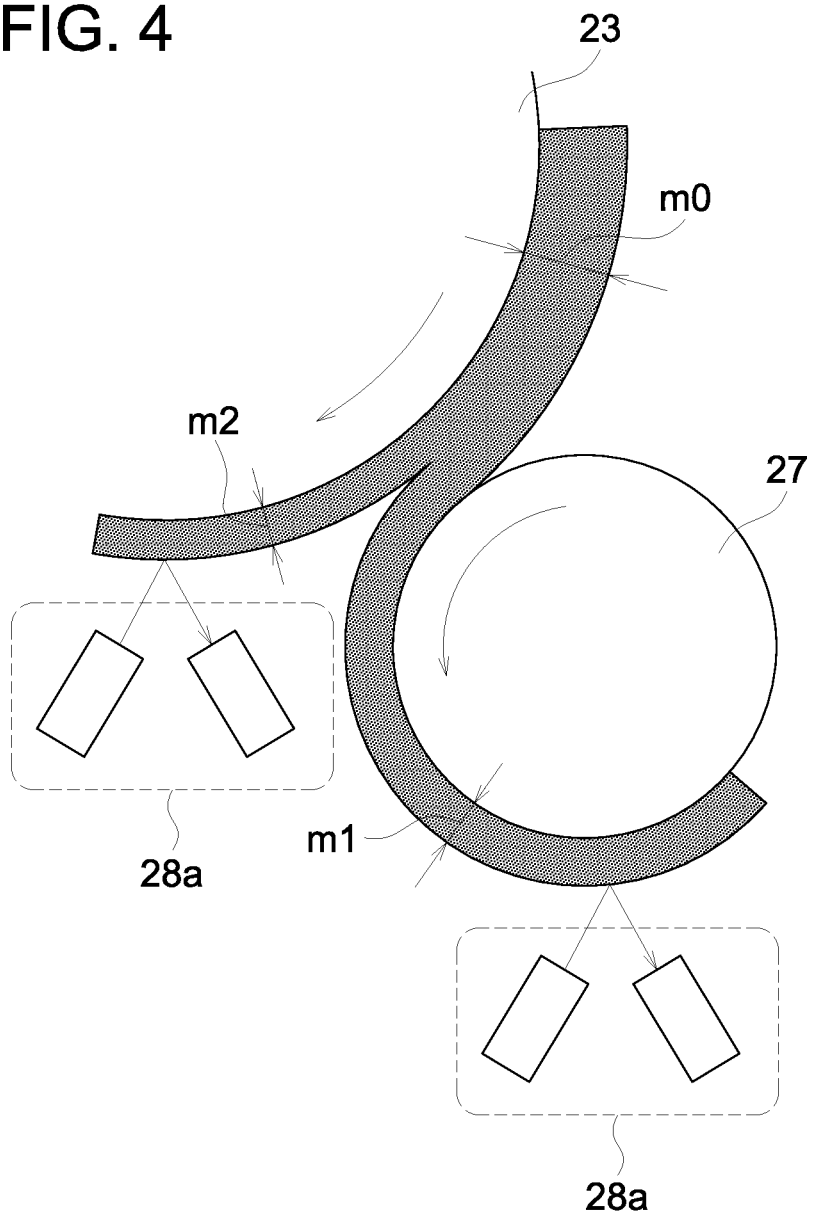
FIG. 4 is a schematic view showing an enlarged aspect of the area wherein the toner carrying member and a detecting roller are opposed to each other in a different embodiment.

FIG. 4 shows an example of the structure in a further embodiment. In the embodiment of FIG. 4, a detecting device capable of detecting the amount of light reflected from the toner layer is used as the toner detecting device 28*a* for optically detecting the toner amount, similarly to the case of FIG. 3. The toner detecting devices 28*a* are each arranged facing the peripheral surface of the detecting roller 27 and the peripheral surface of the toner carrying member 23. This structure ensures that the amount of the toner layer m0 ($m0=m1+m2$) formed on the toner carrying member 23 by the developer carrying member 11 can be obtained from the sum of the toner amount m1 that has been transferred to the detecting roller 27 and the remaining toner amount m2 that has not been transferred to the detecting roller 27, wherein the entire toner layer on the toner carrying member 23 needs not be transferred to the detecting roller 27. This structure eliminates the need of providing the detecting roller 27 or toner carrying member 23 with a difference in circumferential speeds, and allows the detecting roller 27 to be driven by the toner carrying member 23, with the result that the drive device of the detecting roller 27 is simplified. A portion of the toner layer on the toner carrying member 23 can be transferred to the detecting roller 27 such as by physically contacting the toner carrying member 23 with the detecting roller 27, or by adjusting the bias so that a portion of the toner on the toner carrying member 23 is transferred to the detecting roller 27. In the present embodiment, the toner detecting devices 28*a* are placed at two positions; one facing the peripheral surface of the toner carrying member 23, and the other facing the peripheral surface of the detecting roller 27. The amount of toner layer m0 ($m0=m1+m2$) formed on the toner carrying member 23 by the developer carrying member 11 is obtained from the sum of the toner amount m1 that has been transferred to the detecting roller and the remaining toner amount m2 that has not been transferred to the detecting roller 27. If there is certain relationship between the toner amount m1 that has been transferred to the detecting roller 27 and the remaining toner amount m2 that has not been transferred to the detecting roller, it is possible to estimate the total toner amount before a portion of the toner is transferred to the detecting roller 27 if the toner amount m2 remaining on the toner carrying member 23 alone is detected. In this case, the toner detecting device 28 can be arranged facing only the peripheral surface of the toner carrying member 23, and the optical type of the toner detecting device 28*a* that detects the toner amount from the light reflected from the toner layer on the toner carrying member 23 can be used.

Figure 5:
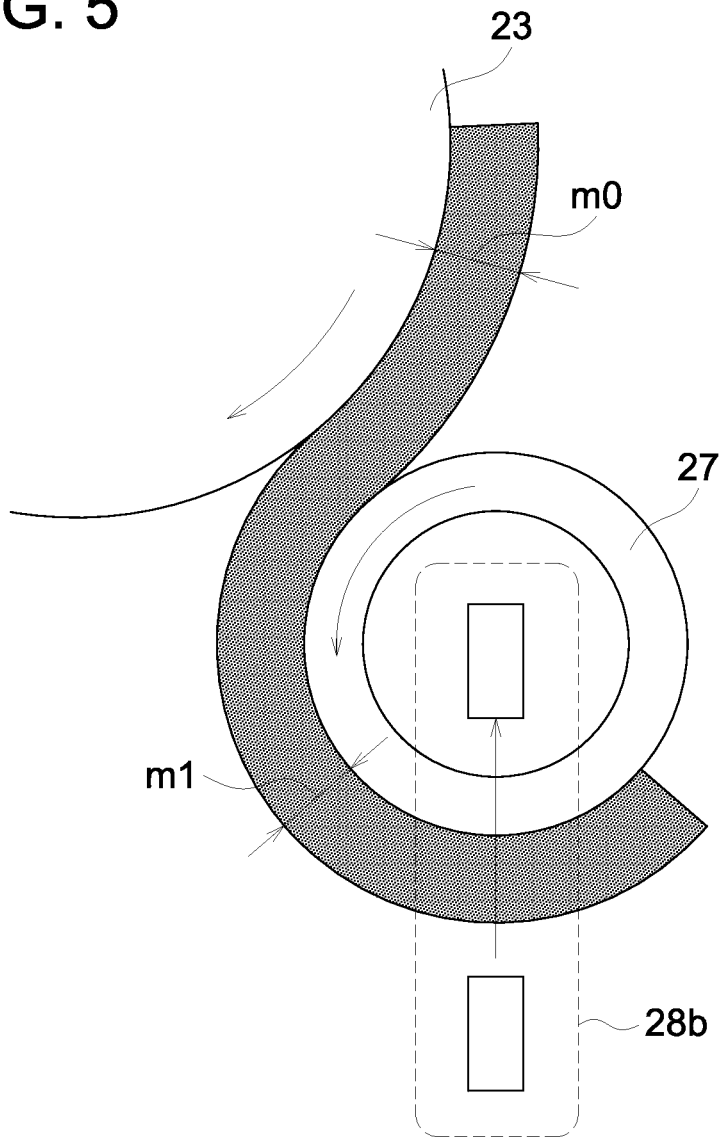
FIG. 5 is a schematic view showing that a transmission detecting device for detecting the amount of the toner is used.

A still further embodiment is represented by an example of the structure shown in FIG. 5. In the embodiment of FIG. 5, a transmission device is used as a toner detecting device 28*b*. Use of the transmission toner detecting devices 28*b* has detection sensitivity even in a range of a greater amount of toner, as compared to the reflection type. As shown in FIG. 5, a light emitting element and a light receiving element are arranged with the detecting roller 27 and toner layer formed thereon being located between the light emitting element and the light receiving element. The light receiving element detects the amount of light which is emitted from the light emitting element and has passed through the detecting roller 27 and the toner layer, whereby the toner amount held on the detecting roller 27 can be measured. The toner carrying member 23 is required to meet various types of requirements such as toughness, dimensional accuracy, electric properties, charging properties, release characteristics, surface roughness, and cost. Therefore, a substrate, a surface layer and others are subject to many restrictions, and a roller having translucency is not always applicable.

In the meantime, in the detecting roller 27, a substrate of high translucency may be used for the detecting roller 27, which is not subjected to many of such restrictions. This allows detection of a greater amount of toner by the transmission toner detecting device 28. Further, in FIG. 5, the amount m0 of the toner layer formed on the toner carrying member 23 can be the same as the toner amount m1 that has been transferred to the detecting roller 27. Alternatively, as shown in FIG. 3, the circumferential speeds of the two rollers can be different so that the amount m1 of the toner layer is less than the amount m0 of the toner layer, whereby detection sensitivity of the amount m0 of the toner layer can be enhanced. In the example of the structure in FIG. 4, the toner detecting device 28*a* for the detecting roller 27 can be replaced by the transmission toner detecting device 28*b*.

As shown in FIG. 2, the electric power supply 30 for the detecting roller 27 is capable of switching the direction of the electric field applied between the toner carrying member 23 and detecting roller 27. In any one of the embodiments shown in FIG. 3 through FIG. 5, after the amount of toner held on the detecting roller 27 has been detected, the toner layer transferred to the detecting roller 27 is returned to the toner carrying member 23 by switching the electric field to the direction opposite to that at the time of transfer of the toner from the toner carrying member 23 to the detecting roller 27. This eliminates the possibility of unwanted waste of toner.

The following notes the positional relationship among the image carrier 1, toner carrying member 23, and detecting roller 27 in the longitudinal direction.

The present embodiment is characterized in that a toner carrying area on the surface of the toner carrying member is broader in the direction of rotating axis of the toner carrying member 23 than an image forming area on a surface of the image carrier, and that the toner is transferred to the detecting roller from a part of the toner carrying area on the surface of the toner carrying member, which part does not face the image forming area of the image carrier.

Figure 6:
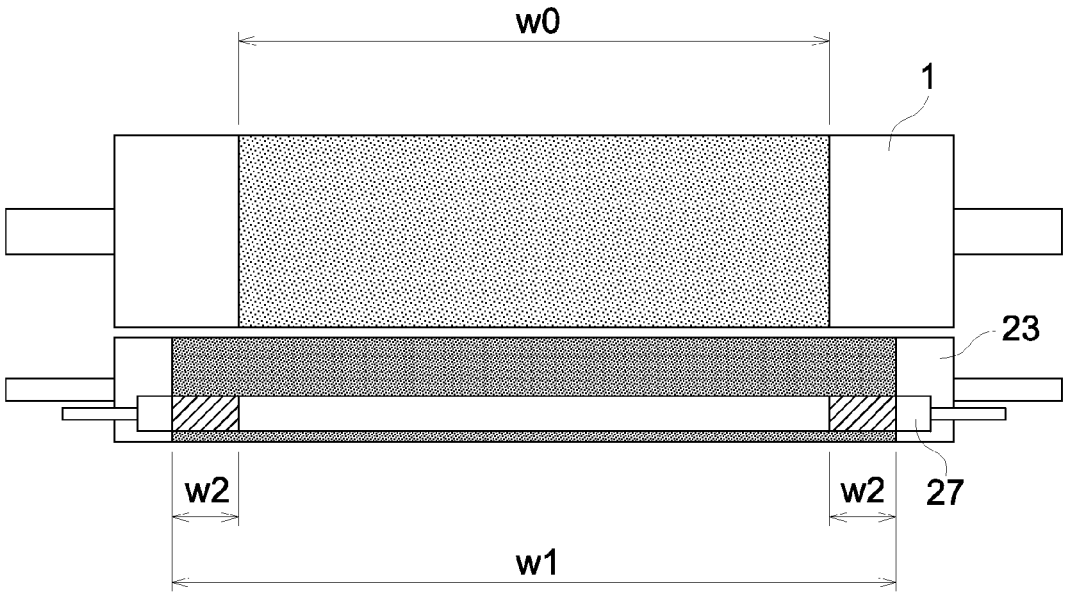
FIG. 6 is a schematic view showing the positional relationship among the image forming area, toner carrying area, and non-image-forming area.

FIG. 6 shows the positional relationship among the image forming area w0 wherein an electrostatic latent image is formed on the surface of the image carrier 1; the toner carrying area w1 wherein a toner layer is formed on the surface of the toner carrying member 23; and a non-facing part w2 of the toner carrying area w1, which non-facing part does not face the image forming area of the image carrier 1. The structure is designed in such a way that the toner on the non-facing part w2 of the toner carrying member 23 is transferred to the detecting roller 27 so that toner will not be transferred from the facing part which faces the image forming area w0 of the toner layer on the toner carrying member 23. This structure ensures that the toner amount held on the toner carrying member 23 can be detected without the image forming operation being affected. This allows the toner amount detection and image forming operation to be performed simultaneously, and ensures quick and accurate detection of the toner amount at any time, without the timings for detecting the toner amount being restricted to the time of non-image formation.

In all of the embodiments described with reference to FIG. 1 through FIG. 5, the positional relationship among the image carrier 1, toner carrying member 23, and detecting roller 27 in the longitudinal direction is determined as described above.

If the toner transferred to the detecting roller 27 is transferred from a part of the toner carrying area w1 on the toner carrying member 23, which part faces the image forming area w0 on the image carrier 1, the toner amount on the toner carrying member 23 is reduced. This makes it difficult to develop an electrostatic latent image on the image carrier 1 with sufficient density. To solve this problem, detection of the toner amount and the image forming operation must be performed at different time point. The timings for detecting the toner amount will be restricted to the time of non-image formation. However, these problems are solved by the structure of the present embodiment.

Examples of the structures of the detecting roller 27 according to the present embodiment include: the roller having a smaller diameter in the non-detection area (the area facing the image forming area w0 of the image carrier 1) to avoid contact with the toner carrying member 23; the roller having only the width of the detection area (area w2 not facing the image forming area); and the roller wherein the electric field for causing a substantial toner transfer is prevented from being formed in the image forming area w0 by insulating the part of the roller facing the image forming area w0 or applying a reverse bias thereto so that a bias to transfer the toner is applied only to the detecting area of the detecting roller 27. As described above, these structures ensure that toner is not transferred to the detecting roller 27 from the part of the toner layer on the toner carrying member 23, which part faces the image forming area w0.

The following describes the structure of the toner amount control system. This control system controls the detection of the toner amount held on the toner carrying member 23, and controls the amount of toner held on the toner carrying member 23 to an appropriate level based on the data obtained from the result of this detection.

Figure 7:
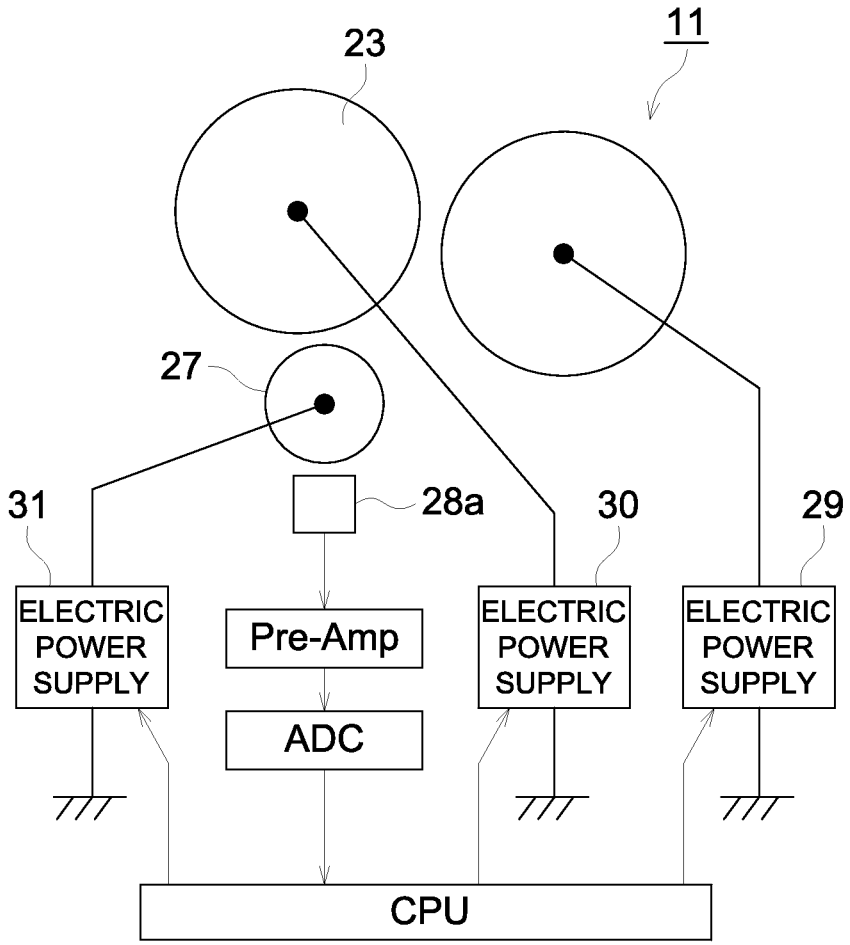
FIG. 7 is a block diagram representing an example of the structure of a toner amount control system for providing control in such a way as to detect the toner amount and to maintain the toner amount at a proper level.

FIG. 7 is a block diagram showing the toner amount control system in the present embodiment. The developer carrying member 11 is connected with the electric power supply apparatus 29 for supplying toner to the toner carrying member 23. The toner carrying member 23 is also connected with the electric power supply apparatus 30 that generates bias for development. These electric power supply apparatuses 29 and 30 can be a direct current (DC) voltage or a DC voltage superimposed with alternating current (AC) voltage. Suspension of the output from these electric power supply apparatuses 29 and 30 or modification of the DC bias level or AC bias parameter is controlled by the signal sent from the CPU (Central Processing Unit). The bias of the electric power supply apparatus 30 is used, for example, to adjust the image density when the latent image on the image carrier 1 is to be developed. Further, the electric power supply apparatus 29 and electric power supply apparatus 30 are used to control the potential difference between the toner carrying member 23 and developer carrying member 11, namely, to control the amount of toner supplied to the toner carrying member 23 from the developer carrying member 11. These power supply apparatuses are controlled by the CPU.

The detecting roller 27 is connected with the electric power supply apparatus 31 for transferring the toner on the toner carrying member 23. This electric power supply apparatus 31 is capable of controlling the timings for turning on or off the bias to transfer the toner from the toner carrying member 23, or the timings of turning on or off the bias to ensure that the toner having been transferred to the detecting roller 27 will go back to the toner carrying member 23. This electric power supply apparatus 31 is controlled by the CPU. The toner detecting device 28*a* as an optical sensor for detecting the toner amount on the detecting roller 27 is installed in the vicinity of the circumference of the detecting roller 27 on a non-contact basis. After having been amplified by a preamplifier, these signals are fed to the A/D converter, and are then input into the CPU as values representing the amount of reflected light.

Figure 8:
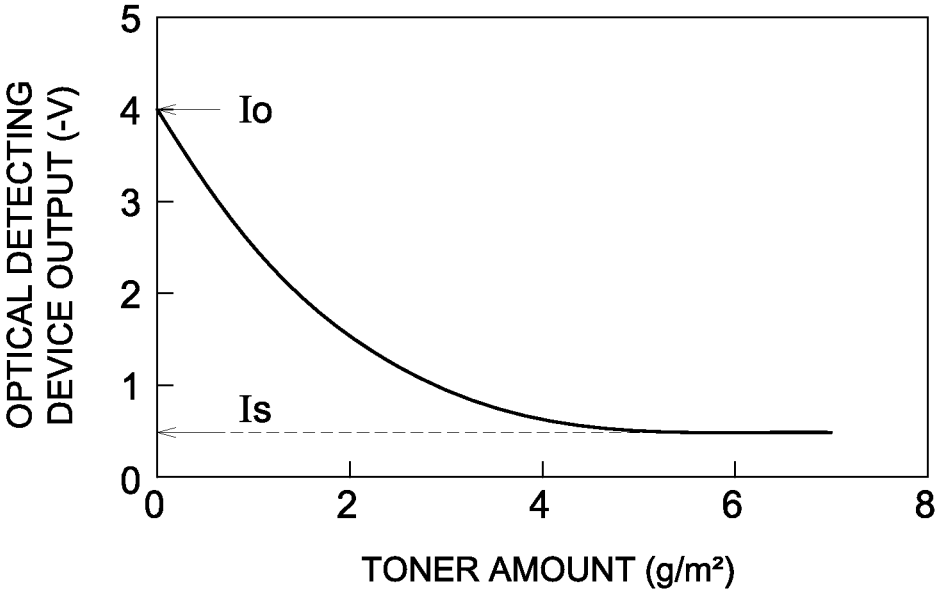
FIG. 8 is a diagram representing an example of the characteristic curve showing the relationship between the output of the optical device for detecting the toner amount and the toner amount.

The following relationship holds between the amount of light reflected by the detecting roller 27 and captured by the toner detecting device 28*a* and the toner amount on the detecting roller 27. When the toner amount is smaller, the amount of reflected light is greater and the output of the toner detecting device 28*a* is higher. When the toner amount is greater, the amount of reflected light is smaller and the output of the toner detecting device 28*a* is lower. FIG. 8 shows an example of the characteristic curve representing the relationship between the output of the toner detecting device 28*a* and the toner amount. FIG. 8 shows the output Io obtained from the light reflected from the surface of the detecting roller 27 when no toner is deposited, and the output Is when the reflection from the surface of the toner layer is almost exclusive as a result of an increase in the toner amount, almost without any reflection from the surface of the detecting roller 27. To get sufficient image density, the toner amount on the toner carrying member 23 is often set at 4 g/m$^2$ or more. It is difficult to achieve high-precision detection of changes in the toner amount in the range of 4 g/m$^2$ or more, using the toner detecting devices to detect directly from the amount of light reflected from the toner layer on the toner carrying member 23. Then, by transferring at least a portion of the toner on the toner carrying member 23 to the detecting roller 27 so as to reduce the toner amount to below 3 g/m$^2$, for example, sufficient level of sensitivity and high-precision detection of the toner amount can be achieved. The relationship between the toner amount transferred to the detecting roller 27 and the toner amount on the toner carrying member 23 prior to transfer is measured in advance and the measured data is stored as Table 1 in the CPU. Further, the characteristic curve for the toner amount transferred to the detecting roller 27 and the output value detected by the toner amount detecting device 28*a* is stored as Table 2 in the CPU in advance.

In the next step, the toner amount on the detecting roller 27 for the purpose of detection is measured by the toner detecting device 28. The output value and Table 2 are compared to read out the toner amount on the detecting roller 27. The toner amount having been read out is compared with Table 1, and whereby the toner amount on the toner carrying member 23 prior to toner transfer is read out. Based on the toner amount held on the toner carrying member 23 obtained in this manner, if the toner amount is lower than a prescribed level, for example, the electric power supply apparatus 29 connected to the developer carrying member 11 may be controlled by the CPU in order to increase the amount of toner supplied from the developer carrying member 11. Alternatively, the rotating speed of the developer carrying member 11 may be changed under the control of the CPU to change the amount of toner supplied to the toner carrying member 23. Further, the method of detecting the toner amount on the toner carrying member 23 in the present embodiment enables the toner amount on the toner carrying member 23 to be detected even during the image forming operation. Thus, based on the result of detecting toner amount on the toner carrying member 23, the electric power supply apparatus 30 connected to the toner carrying member 23 is feedback-controlled, whereby appropriate developing conditions is formed.

Further, as the toner amount can be detected during the image forming operation, the detection may be conducted at any desired timing, and whereby high quality images are obtained quickly.

To ensure more stable maintenance of the toner amount on the toner carrying member 23, the toner amount is preferably detected frequently. As a preferred timing for detecting and controlling the toner amount at a higher frequency, the following equation should be satisfied, wherein the rotating cycle of the detecting roller 27 is T1; the toner transfer direction switching cycle for transfer from the toner carrying member 23 to the detecting roller 27 (a cycle of switching the direction of electric field between the transfer of toner from the toner carrying member 23 to the detecting roller 27 and the transfer of toner in the reverse direction) is T2; and the time ratio of toner transfer in each direction (time ratio required for toner transfer) is 1:

$$T1=\{n+(1/2)\}T2 \text{ (wherein "n" is an integer)}$$

Figure 9:
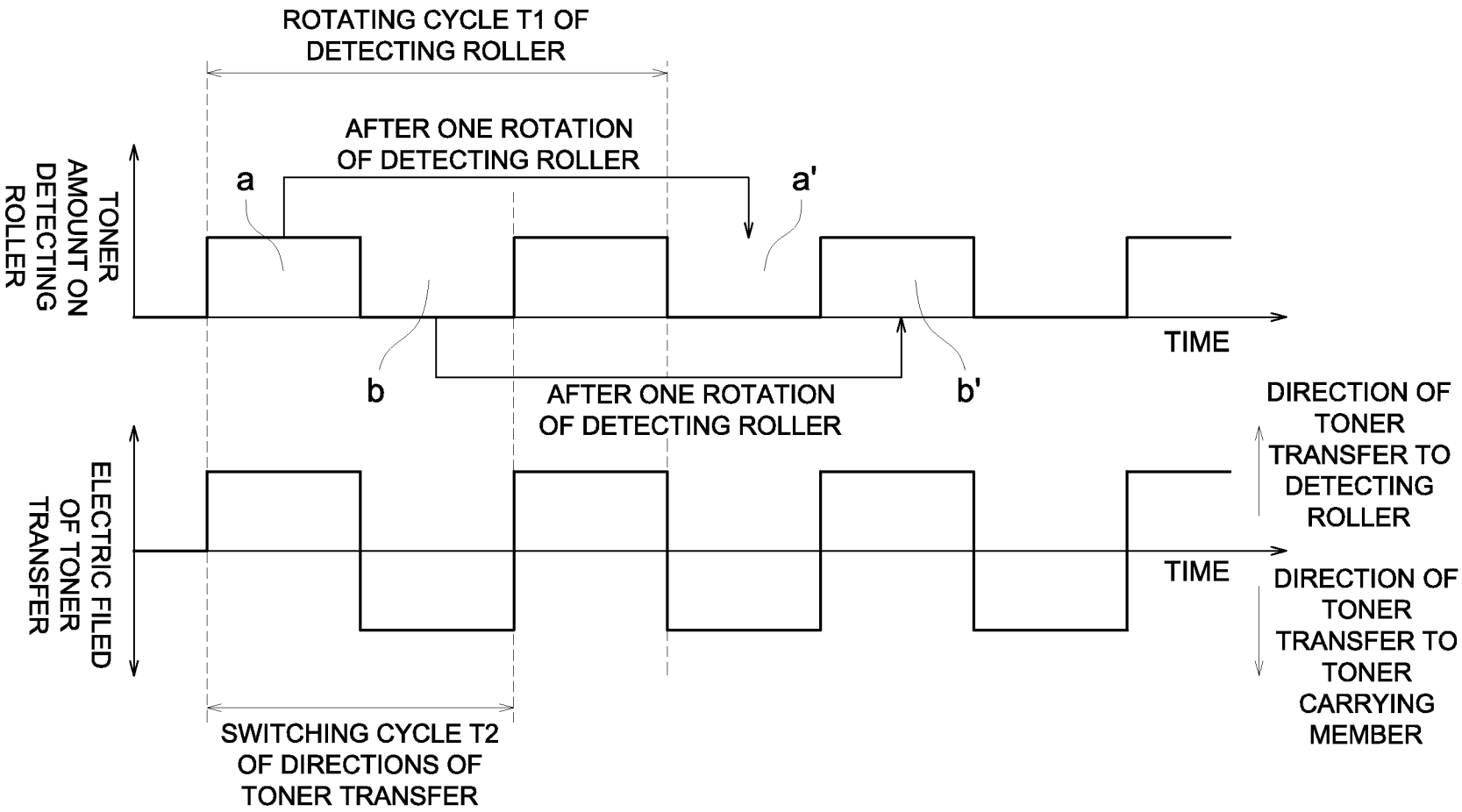
FIG. 9 is a schematic view showing the temporal changes in the amount of toner held on the detecting roller, and temporal changes in the direction of the electric field toner transfer.

If this equation is satisfied, the ratio between the time period required for the toner to be transferred from the toner carrying member 23 to the detecting roller 27 and the time period for the toner not to be transferred (ON/OFF ratio) is 1. The toner carrying areas and non-carrying areas move on the surface of the detecting roller 27 in a striped pattern at an equally spaced interval. FIG. 9 explains the temporal change in the toner amount on the detecting roller and temporal change in the direction of the electric field of toner transfer corresponding to the change in the toner amount, when n=1. The toner transfer direction switching cycle is displaced from the rotating cycle T1 of the detecting roller 27 by a half cycle. Thus, the ON-area "a" wherein toner transfers from the toner carrying member 23 to the detecting roller 27 is returned to the toner carrying member 23 by the electric field of toner transfer in the direction opposite to the electric field that was one cycle before (the area becomes an OFF-area; "a" in the drawing) when the detecting roller makes one rotation to come again to the area facing the toner carrying member 23. Similarly, new toner is transferred from the toner carrying member 23 to the OFF-area "b" wherein toner is not held on the detecting roller 27, by the electric field of toner transfer displaced by a half cycle after one rotation of the detecting roller, and this area becomes an ON-area ("b" in the drawing). By setting the rotating cycle T1 of the detecting roller 27 and toner transfer direction switching cycle T2 in this manner, the toner held on the detecting roller 27 is be returned to the toner carrying member 23 at every rotation of the detecting roller 27. Thus, resetting can be made without the toner being built up on the surface of the detection roller. This arrangement permits detection of the toner amount at a higher frequency.

As is apparent from the above description, the present embodiment ensures that the amount of toner held on the toner carrying member 23 can be detected at a higher frequency even in the image forming operation. By controlling the conditions of forming the toner layer on the toner carrying member 23, the amount of toner held on the toner carrying member 23 can be maintained at a stable level. This allows the development characteristics to be maintained at a stable level, and ensures a stable supply of high-quality images.

In each of the above embodiments, after at least a portion of the toner on a non-facing part of the toner carrying area, which non-facing part does not face the image-forming area, has been transferred onto the detecting roller, detection is conducted by the toner detecting devices. This method enhances detection accuracy and increases detection frequency. This technique provides a development apparatus capable of stable supply of high-quality images and an image forming apparatus using the same, wherein the toner amount held on the toner tallying member, which toner amount has a serious impact on the image quality, can be controlled to a high level of precision, based on the result of the detection thereof.

The aforementioned embodiments are to be considered in all respects as illustrative and not restrictive. The scope of the invention is indicated by the appended claims rather than by the foregoing description. All changes that come within the meaning and range of equivalency of the claims are therefore intended to be embraced herein.

What is claimed is:

1. A development apparatus, comprising:

a toner carrying member configured to be supplied with toner, in a toner-supply area, and hold and carry the toner on a surface thereof, and convey the toner to an image carrier facing the toner carrying member, so as to develop an electrostatic latent image formed on the image carrier, wherein the toner is carried on a toner carrying area on the surface of the toner carrying member, said toner carrying area being broader in the direction of an axis of rotation of the toner carrying member than an image forming area on a surface of the image carrier in the direction of an axis of rotation thereof;

a detecting roller provided on a downstream side from the toner-supply area so as to face the toner carrying member, the detecting roller configured to hold and carry at least part of the toner transferred from a non-facing part of the toner carrying area on the surface of the toner carrying member so that an amount of the toner on the non-facing, part is reduced, said non-facing part not facing the image forming area of the image carrier;

a toner detecting device configured to detect optically quantity of the toner transferred to and held on said detecting roller, or quantity of the toner remaining on said non-facing part of the toner carrying area without having been transferred to said detecting roller;

a controller configured to control transfer of the toner from the toner carrying member to the detecting roller so that a thickness of a toner layer formed on the detecting roller is smaller than a thickness of a toner layer formed on the toner carrying member before the toner being transferred to the detecting roller; and wherein said controller is configured to control detection of quantity of the toner on said detecting roller by said toner detecting device so that the detection is conducted in the course of forming an image by developing an electrostatic latent image formed on the image carrier.

2. An image forming apparatus which includes the development apparatus as claimed in claim 1, the image forming apparatus, comprising the image carrier configured to rotate and carry the electrostatic latent image formed thereon.

3. A development apparatus, comprising:

a toner carrying member configured to be supplied with toner, in a toner-supply area, and configured to hold and carry the toner on a surface thereof, and convey the toner to an image carrier facing the toner carrying member, so as to develop an electrostatic latent image formed on the image carrier, wherein the toner is carried in a toner carrying area on the surface of the toner carrying member, said toner carrying area being broader in the direction of an axis of rotation of the toner carrying member than an image forming area on a surface of the image carrier in the direction of an axis of rotation thereof;

a detecting roller provided on a downstream side from the toner-supply area so as to face the toner carrying member, the detecting roller configured to hold and carry at least part of the toner transferred from a non-facing part of the toner carrying area on the surface of the toner carrying member so that an amount of the toner on the non-facing part is reduced, said non-facing part not facing the image forming area of the image carrier;

a toner detecting device configured to detect optically quantity of the toner having been transferred to and held on said detecting roller;

a controller configured to control transfer of the toner from the toner carrying member to the detecting roller so that a thickness of a toner layer formed on the detecting roller is smaller than a thickness of a toner layer formed on the toner carrying member before the toner being transferred to the detecting roller; and wherein said controller is configured to control detection of quantity of the toner on said detecting roller by said toner detecting device so that the detection is conducted in the course of forming an image by developing an electrostatic latent image formed on the image carrier.

4. A development apparatus of claim 3, wherein said toner detecting device detects quantity of the toner on the surface of the detecting roller by emitting light toward the toner layer formed on the surface of the detecting roller and detecting light reflected from the toner layer.

5. A development apparatus of claim 3, wherein a circumferential speed at the surface of said detecting roller is larger than a circumferential speed at the surface of said toner carrying member.

6. A development apparatus of claim 3, comprising a second toner detecting device, wherein said controller is configured to control transfer of the toner from the toner carrying member to the detecting roller so that a portion of the toner on said non-facing part of the toner carrying area on the surface of the toner carrying member is transferred to the detecting roller, said second toner detecting device detects optically quantity of the toner remaining on said non-facing part of the toner carrying area without being transferred to the detecting roller.

7. A development apparatus of claim 3, wherein said controller is configured to control transfer of the toner from the detecting roller back to the toner carrying member so that the transfer of the toner from the detecting roller back to the toner carrying member is conducted after quantity of said toner on the surface of the detecting roller is detected by the toner detecting device.

8. A development apparatus of claim 7, further comprising an electric power supply for said detecting roller, said electric power supply being configured to provide a first electric voltage configured to produce a first electric field to transfer the toner from said toner carrying member to said detecting roller , and a second electric voltage configured to produce a second electric field to transfer the toner from the detecting roller back to the toner carrying member, where T1 is a rotating cycle of the detecting roller and T2 is a switching cycle of switching the first voltage and the second voltage, and the following equation is satisfied when time required for transfer of the toner from the toner carrying member to the detecting roller is the same as time required for transfer of the toner from the detecting roller to the toner carrying member:

$$T1=\{n+(1/2)\}T2.$$

9. A development apparatus of claim 3, wherein said controller is configured to control quantity of the toner carried and held on said toner carrying member based on a result of the detection by said toner detecting device.

10. A development apparatus of claim 3, wherein said controller is configured to control conditions to develop said electrostatic latent image formed on said image carrier with the toner carried by said toner carrying member based on a result of the detection by said toner detecting device.

11. A development apparatus of claim 3, wherein said controller is configured to control transfer of the toner from said toner carrying member to said detecting roller so that the toner on a facing part of the toner carrying area is prevented from being transferred, said facing part facing the image forming area on the surface of said image carrier.

12. A development apparatus of claim 3, wherein said detecting roller is insulated from or does not contact a facing part of the toner carrying area, said facing part facing the image forming area on the surface of said image carrier.

13. An image forming apparatus, which includes the development apparatus as claimed in claim 3, the image forming apparatus, comprising the image carrier configured to rotate and carry an electrostatic latent image formed thereon.

14. A development apparatus, comprising:

a toner carrying member configured to be supplied with toner, in a toner-supply area, and hold and carry the toner on a surface thereof, and convey the toner to an image carrier facing the toner carrying member to develop an electrostatic latent image formed on the image carrier, wherein the toner is carried on a toner carrying area on the surface of the toner carrying member, said toner carrying area being broader in the direction of an axis of rotation of the toner carrying member than an image forming area on a surface of the image carrier in the direction of an axis of rotation thereof;

a detecting roller provided on a downstream side from the toner-supply area so as to face the toner carrying member, the detecting roller configured to hold and carry at least part of the toner transferred from a non-facing part of the toner carrying area on the surface of the toner carrying member so that an amount of the toner on the non-facing part is reduced, said non-facing part not facing the image forming area on the surface of the image carrier;

a toner detecting device configured to detect optically quantity of the toner remaining on said non-facing part of the toner carrying area without having been transferred to the detecting roller;

a controller configured to control transfer of the toner from the toner carrying member to the detecting roller so that a thickness of a toner layer formed on the detecting roller is smaller than a thickness of a toner layer formed on the toner carrying member before the toner being transferred to the detecting roller; and wherein said controller is configured to control detection of quantity of the toner on said detecting roller by said toner detecting device so that the detection is conducted in the course of forming an image by developing an electrostatic latent image formed on the image carrier.

15. A development apparatus of claim 14, wherein said toner detecting device detects quantity of the toner on the surface of the detecting roller by emitting light toward the toner layer formed on the surface of the detecting roller and detecting light reflected from the toner layer.

16. A development apparatus, comprising:

a toner carrying member configured to hold and carry toner on a surface thereof and convey the toner to an image carrier facing the toner carrying member to develop an electrostatic latent image formed on the image carrier, wherein the toner is carried on a toner carrying area on the surface of the toner carrying member, said area being broader in the direction of an axis of rotation of the toner carrying member than an image forming area on a surface of the image carrier in the direction of the axis of rotation thereof;

a detecting roller provided facing the toner carrying member, the detecting roller configured to hold and carry the toner transferred from a non-facing part of the toner carrying area on the surface of the toner carrying member, said non-facing part not facing the image forming area on the surface of the image carrier, said detecting roller having translucency; and a toner detecting device configured to detect optically quantity of the toner transferred to and held on the detecting roller by measuring amount of light transmitted through the detecting roller and a toner layer formed on a surface of the detecting roller; and a controller configured to control detection of quantity of the toner on said detecting roller by said toner detecting device so that the detection is conducted in the course of forming an image by developing an electrostatic latent image formed on the image earlier.

17. A development apparatus of claim 16, wherein said controller is configured to control transfer of the toner from the detecting roller back to the toner carrying member so that transfer of the toner from the detecting roller back to the toner carrying member is conducted after quantity of said toner on the surface of the detecting roller is detected by the toner detecting device.

18. A development apparatus of claim 17, further comprising an electric power supply for said detecting roller, said electric power supply being configured to provide an electric voltage to transfer the toner from said toner carrying member to said detecting roller and an electric voltage to transfer the toner from the detecting roller back to the toner carrying member, where T1 is a rotating cycle of the detecting roller and T2 is a switching cycle to switch an electric field to transfer the toner from the toner carrying member to the detecting roller and an electric field to transfer the toner from the detecting roller to the toner carrying member, said electric fields being created by the electric voltages made by said electric power supply and the following equation is satisfied when time required for transfer of the toner from the toner carrying member to the detecting roller is the same as time required for transfer of the toner from the detecting roller to the toner carrying member:

$$T1=\{n+(1/2)\}T2.$$

19. A development apparatus of claim 16, wherein said controller is configured to control quantity of the toner carried and held on said toner carrying member based on a result of the detection by said toner detecting device.

20. A development apparatus of claim 16, wherein said controller is configured to control conditions to develop said electrostatic latent image formed on said image carrier with the toner carried by said toner carrying member based on a result of the detection by said toner detecting device.

21. An image forming apparatus, which includes the development apparatus as claimed in claim 16, the image forming apparatus, comprising the image carrier configured to rotate and carry an electrostatic latent image formed thereon.

* * * * *